United States Patent [19]

Suris

[11] Patent Number: 5,061,222

[45] Date of Patent: Oct. 29, 1991

[54] COIN HOPPER AND DISPENSER

[75] Inventor: Vladimir Suris, Mayfield Heights, Ohio

[73] Assignee: Dixie-Narco, Inc., Ranson, W. Va.

[21] Appl. No.: 503,456

[22] Filed: Apr. 2, 1990

[51] Int. Cl.[5] ..... G07D 1/00

[52] U.S. Cl. ..... 453/57; 221/235; 221/252; 221/267

[58] Field of Search ..... 453/32 TO, 35, 49, 57; 194/200; 221/203, 235, 263, 265, 267, 252

[56] References Cited

U.S. PATENT DOCUMENTS

| | | | |
|---|---|---|---|
| 3,814,296 | 6/1974 | Tschritter | 222/220 |
| 4,398,550 | 8/1983 | Shireman | 453/32 |
| 4,441,515 | 4/1984 | Goepner | 453/32 |
| 4,466,453 | 8/1984 | Said et al. | 453/8 |
| 4,589,433 | 5/1986 | Abe | 453/57 |
| 4,798,558 | 1/1989 | Bellis | 453/33 X |
| 4,923,430 | 5/1990 | Iimura | 221/267 X |

FOREIGN PATENT DOCUMENTS

| | | | |
|---|---|---|---|
| 0064822 | 11/1982 | European Pat. Off. | 453/57 |
| 1445089 | 8/1976 | United Kingdom | 453/33 |
| 2185341 | 7/1987 | United Kingdom | 453/49 |
| 2208738 | 4/1989 | United Kingdom | 453/32 |

*Primary Examiner*—F. J. Bartuska

*Attorney, Agent, or Firm*—Renner, Kenner, Greive, Bobak, Taylor & Weber

[57] ABSTRACT

A coin hopper and dispenser is provided for receiving coins in bulk and singularly and reliably dispensing them. A rotating disc is received within a housing bore below the hopper, the disc having a number of coin receiving bores passing therethrough. On a bottom surface of the disc, riding upon a bottom plate surface within the housing bore, is a dispensing wheel having a thickness slightly greater than the thickness of the coins to be dispensed. The dispensing wheel has arms thereon extending between the coin receiving bores of the disc, the arms urging coins against a deflection spring which directs them through a coin slot. A spring retention plate is provided at the exterior of the coin slot to assure that the coins are overtly dispensed by rotation of the disc.

13 Claims, 2 Drawing Sheets

COIN HOPPER AND DISPENSER

TECHNICAL FIELD

The invention herein resides in the art of bulk coin hoppers of the type often used in currency changers or the like. Specifically, the invention relates to a bulk coin hopper for use in association with a validator, changer, or other equipment requiring the dispensing of coins, tokens, or the like.

BACKGROUND ART

Herefore, various types of coin or token hoppers have been known and utilized in the changer and dispensing art. A common type is that known as an indirect payout hopper in which coins are loaded into a hold or escrow position from which they are subsequently dispensed when the validity of tendered currency is determined. In such systems, a belt is often used to transport coins from a bulk chamber to a chute or channel in which they are maintained until a payout is requested. In these systems, two steps for any payout are required, the first being the loading of the chute or channel and the second being the actual vending of the coins. Also slowing down the changing process is the fact that the chutes or channels have typically been too small to maintain sufficient coins for changing larger denominations of currency.

Known direct payout hoppers have often incorporated a large rotating disc having protrusions thereon which engage coins and carry them past a stripper where coins are separated from each other and subsequently dispensed by gravity. Such prior systems require repetitive servicing to assure proper operation. Other proposed systems include rotating discs having passages therethrough which pass into and out of alignment for the passage of coins. Many such systems require that the coin receiving discs at the bottom of the hopper be inclined to facilitate feeding of the coins to the discs. Such not only increases the cost of such systems, but reduces the effective size of the hopper by angling the bottom thereof.

Other direct payout hoppers utilizing one or more pairs of rotating discs with or without coin-receiving receptacles therein have been known. U.S. Pat. Nos. 3,814,296, 4,398,550, 4,466,453, and 4,441,515, as well as European Patent 204,405 teach such structures and techniques. However, such prior art structures have been rather complex in nature and given to varying degrees of unreliability in service and operation.

In light of the foregoing, there has been recognized a need for a direct payout hopper which is rapid and reliable in operation. Such a hopper needs to accommodate the changing of large bills in short time cycles such as by dispensing coins directly from a bulk hopper without having to transport the coins to escrow or a hold position first. Accordingly, the only limitation for the number of coins to be dispensed in a single dispensing operation would be the volume of the hopper itself. In light of prior art structures which have sought these advantages, it has also been recognized that there is a need for a system in which coins being transferred from one receptacle to another evidence a significant dwell time of the two receptacles so that the transfer may be reliably made.

DISCLOSURE OF INVENTION

In light of the foregoing, it is a first aspect of the invention to provide a coin hopper and dispenser which achieves a direct payout of coins in response to an appropriate request.

Another aspect of the invention is the provision of a bulk coin hopper which is rapid in operation.

Another aspect of the invention is the provision of a bulk coin hopper having a minimum number of moving parts which may be housed in a compact unit.

A further aspect of the invention is the provision of a bulk coin hopper which is reliable and durable in operation.

Still an additional aspect of the invention in the provision of a bulk coin hopper which is not susceptible to jamming or misfeeding.

Another aspect of the invention is the provision of a bulk coin hopper which can receive and store a large volume of coins in a small amount of space.

A further aspect of the invention is the provision of a bulk coin hopper in which a flexible mat urges coins into receipt by a rotating disc without jamming and the like.

Another aspect of the invention is the provision of a bulk coin hopper in which the rotating disc at the bottom thereof is horizontal, providing the hopper with a flat bottom.

The foregoing and other aspects of the invention which will become apparent as the detailed description proceeds are achieved by a coin dispenser, comprising: a hopper; a base housing receiving said hopper, said base housing having a bore therein; a rotating disc received within said bore; and a first passageway within said base housing interconnecting said bore with an exterior of said base housing.

Further aspects of the invention are attained by a coin dispenser, comprising: a hopper; a base member at a bottom end of said hopper, said base member having a bore therein and a first passageway extending from said bore to an exterior of said base member; a coin dispensing disc rotatably received within said bore; and coin deflection means extending from a bottom plate surface of said bore for deflecting coins carried by said coin dispensing disc upon said bottom plate surface into and out of said first passageway.

DESCRIPTION OF DRAWINGS

For a complete understanding of the objects, techniques, and structure of the invention, reference should be made to the following detailed description and accompanying drawings wherein.

BEST MODE FOR CARRYING OUT THE INVENTION

Figure 1:
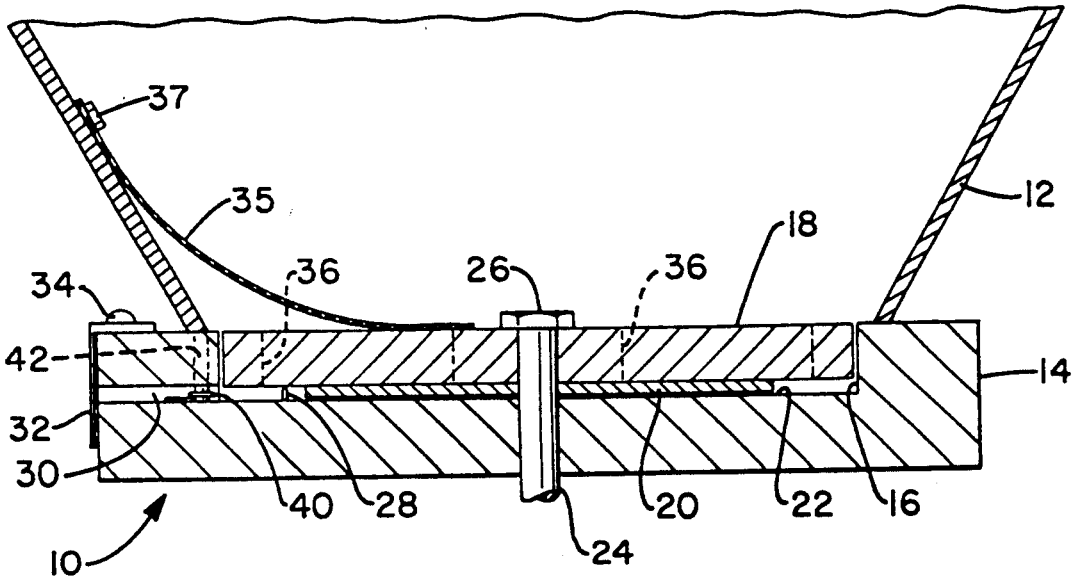
FIG. 1 is an illustrative sectional view of the coin hopper and dispenser of the invention.

Referring now to the drawings, and more particularly FIG. 1, it can be seen that a coin hopper and dispenser according to the invention is designated generally by the numeral 10. As shown, a funnel-shaped hopper 12, adapted for receiving a bulk supply of coins, tokens, or the like, extends upwardly from a base housing 14. The housing 14 may be of any suitable structure, but is preferably manufactured from appropriate metal or the like. The housing 14 has a cylindrical bore 16 received in a top surface thereof.

A coin receiving disc 18 is received within the bore 16, the disc 18 having a payout wheel 20 affixed to a bottom surface thereof and rotatable therewith. The payout wheel 20 is positioned parallel to, and closely adjacent with, the bottom plate surface 22 of the bore 16. It is desired that the clearance between the payout wheel 20 and the bottom plate surface 22 be minimized to prevent any possibility of a coin or other structure from engaging between the plate surface 22 and the payout wheel 20, jamming the system.

The coin receiving disc 18, with attached payout wheel 20, is connected to a shaft 24, driven by a reversible motor or the like, such that the assembly 18, 20 can be caused to selectively rotate in either direction about the shaft 24. A nut, bolt, or other appropriate securing device 26 is provided for securing the disc 18 to the shaft 24.

As further shown in FIG. 1, a deflection spring 28, typically a spring wire, extends upwardly through the plate surface 22, the same being radially displaced from the payout wheel 20 and maintained beneath the outer periphery of the disc 18. As will become apparent hereinafter, the deflection spring 28 engages coins carried by the payout wheel 20, deflecting or directing them into an appropriate coin slot 30 within the housing 14. As will be appreciated from the discussion of FIG. 3, two such coins slots 30 are provided within the housing 14, the same being positioned equal distance and on opposite sides of the deflection spring 28. As will also be appreciated, each of the coin slots 30 has associated therewith a spring plate 32, extending downwardly over the slot 30 as it exits the housing 14, the spring plate 32 being appropriately bolted or otherwise secured to the housing 14 as by bolts 34.

Figure 2:
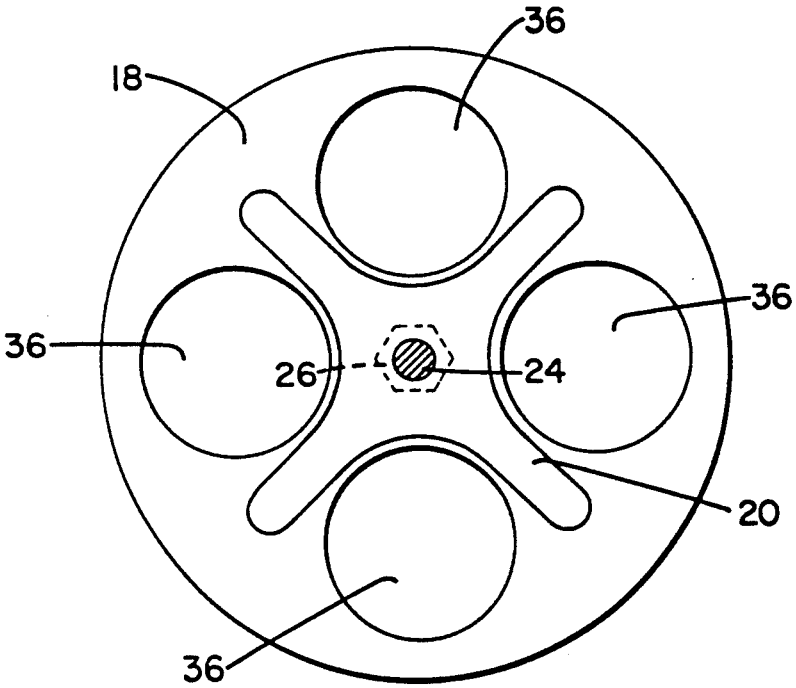
FIG. 2 is a bottom plan view of the coin receiving disc of the invention.

With reference now to FIG. 2, it can be seen that the coin receiving disc 18 has a payout wheel 20 affixed to the bottom surface thereof, with the shaft 24 passing therethrough. The disc 18 has a plurality of coin-receiving bores 36 passing therethrough, the same preferably being uniformly spaced about the center of the disc 18. The bores 36 typically have a diameter slightly larger than the diameter of the coins to be received therein, and preferably on the order of 1.1–1.5 times the diameter of the coin. Further, the thickness of the disc 18 is on the order of 3–6 times the thickness of the coins to be dispensed thereby, it being preferred that each of the bores 36 will, at any particular point in time, hold approximately 4 coins therein.

Referring again to FIG. 1, it can be seen that an agitator 35 is secured to an inner wall of the hopper 12 as by a bolt 37 or the like. The agitator 35 preferably comprises a cord-reinforced elastomeric belt floating upon the rotating disc 18 to urge coins into the bores 36 and to lay flat therein. The belt or agitator 35 will typically cover an arc of the disc 18 of 30°–180° and, to the extent necessary, is generally pie shaped.

As shown in FIG. 2, the payout wheel 20, in the preferred embodiment of the invention, is somewhat of a star shape, having a plurality of arms extending between and separating the bores 36. Typically, the arms of the wheel 20 will extend slightly beyond the center of each of the bores 36, and the payout wheel 20 will have a thickness on the order of 1.0–1.5 times the thickness of the coins to be handled. In a preferred embodiment, the wheel 20 has a thickness equivalent to 1.2 times the thickness of the coins.

Figure 3:
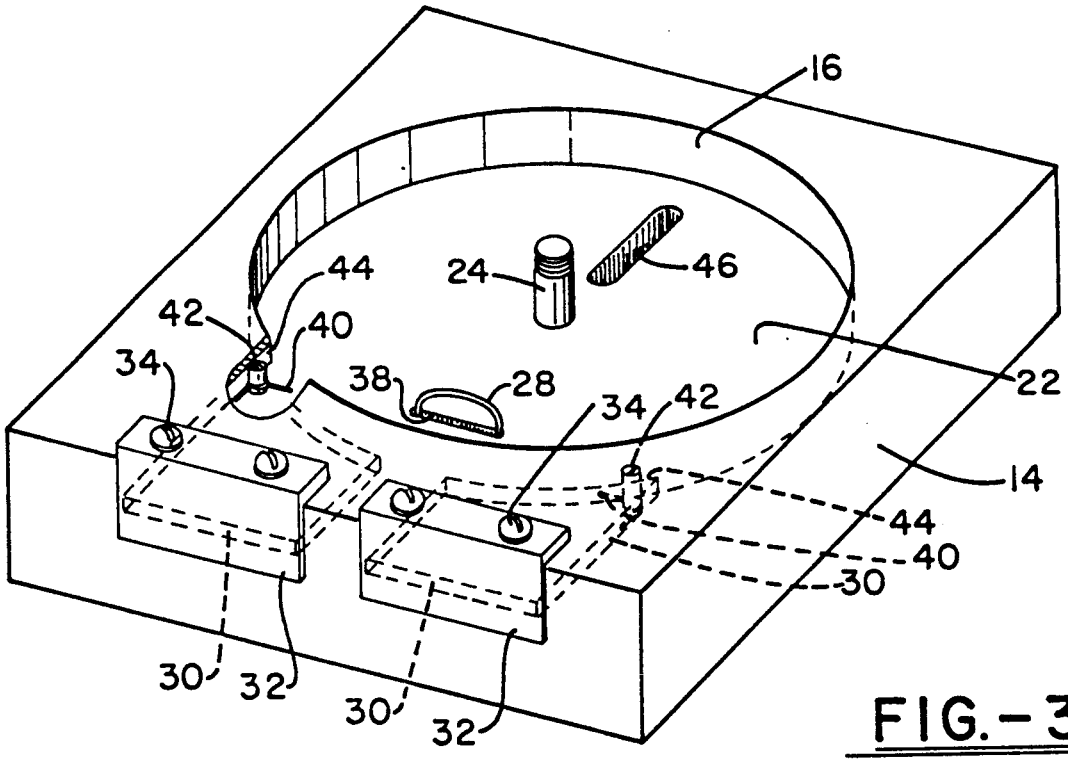
FIG. 3 is a perspective view of the base housing of the coin hopper and dispenser, showing the hopper and coin receiving disc removed.

As shown in FIG. 3, the bottom plate surface 22 of the bore 16 has a slot 38 therein, the same being radially displaced from the center of the bore 16 to be beyond the arms of the payout wheel 20. The deflection spring or spring wire 28 extends upwardly in the form of a loop from the slot 38. As further shown, the deflection spring 28 is positioned equal distance from the coin slots 30 which communicate from the bottom plate surface 22 to the exterior of the housing 14. It will be appreciated that the slots 30 have a height greater than the thickness of the coins to be dispensed, so as to accommodate the handling of bent coins or the like. It will also be appreciated that each of the slots 30 has an associated spring plate 32 extending thereover, the same being of appropriate thin metallic construction or the like.

As shown in FIG. 3, the slots 30 are separated from each other with the deflection spring 28 positioned equidistant therebetween. Each of the slots 30 has a gate spring 40 received by a bolt 42 and having one end thereof biased against an edge of the respective slot 30 such that the other end extends to the edge of the slot 30 at the intersection with the bore 16. The gate springs 40 are positioned at the outer corners 44 of the respective slots 30 preventing jamming of coins at the respective corners 44 upon reversal of rotational direction of the payout wheel 20. It will be appreciated that if the payout wheel 20 ceased rotation in one direction with a coin at one of the corners 44 and then commenced rotation in the opposite direction, the coin could jam against the corner and prevent further rotation of the payout wheel 20. The gate springs 40 provide a bias against the coins away from the corners 44 until the coins clear the springs by entering the slots 30. Accordingly, jamming is eliminated.

It will also be seen that a clean out slot 46 passes through the bottom plate surface 22 of the bore 16. This slot 46 provides an exit for any foreign material which might find its way into the hopper and threaten a jam or other failure. The slot 46 is of less width and length than the diameter of the coins to be received by the hopper 12, precluding such coins from passing therethrough.

In operation, the hopper 12 is filled with a bulk supply of coins. Rotation of the shaft 24 causes the coin receiving disc 18 to similarly rotate, allowing the coins from the hopper 12 to feed into and fill the bores 36. Such feeding and filling is facilitated by the flexible mat or agitator 35 riding upon the disc 18. The bottom most coin in each of the bores 36 is thus caused to ride upon the bottom plate surface 22 of the cylindrical bore 16. Coins are urged in such rotation by the arms of the payout wheel 20, the coins being constrained from leaving the bore 16 by virtue of the sidewall thereof. As the coins approach one of the slots 30, depending upon the direction of rotation of the shaft 24, the leading edge of the coin engages the deflection spring 28, preventing the further rotation movement of the coin within the bore 16. Continued movement of the payout wheel 20 upon the disc 18 urges the coin into the coin slot 30 and against the associated spring plate 32. Accordingly, the coin does not simply drop out of the slot 30, but is actually urged therefrom by the arms of the wheel 20. Obviously, an appropriate sensor or counter, well known in the art, may be associated with either of the slots 30, or with an appropriate receiving payout trough or the like, to count the number of coins actually dispensed to assure a full measure of such dispensing. When such full measure has been dispensed, rotation of the shaft is terminated and the coins within the bores, upon the bottom plate surface 22, and within the appropriate slots 30 and urged against the associated spring plate 32 are maintained until the dispensing operation is engaged anew. It will thus be appreciated that the spring plates 32 prevent coins which might be in the passages 30 at the end of the dispensing cycle from being improperly dispensed by shaking the changer or the like.

It should also be appreciated that the dispensing operation just discussed can be entertained whether the shaft 24 is rotated in a clockwise or counterclockwise direction. In viewing FIG. 3, if the shaft 24 is operated in a clockwise direction, the coins will engage one edge of the deflection spring 28 and be deflected through a first of the coin slots 30, while rotation of the shaft 24 in the opposite direction will cause the coins to engage an opposite edge of the deflection spring 28 and be dispensed from the other coin slot 30. The provision of dual coin slots and spring plates 32 allows the shaft 24 to operate in both rotational directions, of particular benefit is such systems for defeating jams or the like. Further, the gate springs 40 prevent jamming at the corners 44 upon reversal of rotation direction.

Thus it can be seen that the objects of the invention have been satisfied by the structure presented above. While in accordance with the patent statutes only the best mode and preferred embodiment of the invention has been presented and described in detail, it is to be understood that the invention is not limited thereto or thereby. Accordingly, for an appreciation of true scope and breadth of the invention reference should be made to the following claims.

What is claimed is:

1. A coin dispenser, comprising:

a hopper;

a base housing receiving said hopper, said base housing having a bore therein;

a rotating disc received within said bore, said rotating disc being bidirectionally rotatable about an axis and comprising a coin receiving disc having a plurality of bores passing therethrough, and a plate secured to said disc, said plate having a plurality of arms extending between said bores;

a first passageway within said base housing interconnecting said bore with an exterior of said base housing;

a second passageway interconnecting said bore with said exterior of said base housing; and wherein a bottom of said bore comprises a plate, said plate having a deflection spring extending therefrom for deflecting coins from engagement with said arms out of said first and second passageways, said deflection spring interposed equidistant from said first and second passageways.

2. The coin dispenser according to claim 1, wherein said plate has a thickness of 1.0–1.5 times the thickness of a coin intended to be dispensed by the coin dispenser.

3. The coin dispenser according to claim 2, wherein said coin receiving disc has a thickness of 3–5 times the thickness of said coins.

4. The coin dispenser according to claim 1, wherein said rotating disc is bidirectionally rotatable about an axis.

5. The coin dispenser according to claim 1, further comprising a gate spring in each passageway at a point of interconnection with said bore for deflecting coins from a corner defined by intersection of said passageway with said bore.

6. A coin dispenser, comprising:

a hopper;

a base member at a bottom end of said hopper, said base member having a bore therein and first and second passageways extending from said bore to an exterior of said base member;

a coin dispensing disc bidirectionally rotatably received within said bore; and coin deflection means extending from a bottom plate surface of said bore equidistant from said first and second passageways for deflecting coins carried by said coin dispensing disc upon said bottom plate surface into and out of said first and second passageways dependent upon a rotational direction of said disc.

7. The coin dispenser according to claim 6, wherein said coin dispensing disc has a plurality of coin receiving bores passing therethrough.

8. The coin dispenser according to claim 7, further comprising a plate received on a bottom surface of said coin dispensing disc, said plate having arms extending between said bores and maintained in juxtaposition to said bottom plate surface.

9. The coin dispenser according to claim 8, wherein said plate has a thickness greater than the thickness of coins to be dispensed from said hopper, and less than twice the thickness of said coins.

10. The coin dispenser according to claim 6, further comprising first and second coin retention means at respective ends of said first and second passageways at said exterior of said base member for retarding passage of coins from said passageways to said exterior of said base member.

11. The coin dispenser according to claim 6, further comprising spring means in each of said passageways at points of intersection between said bore and said passageways for deflecting coins from said points of intersection and preventing jamming of said coin dispensing disc upon reversal of rotational directions thereof.

12. The coin dispenser according to claim 7, further comprising a flexible mat extending from a sidewall of said hopper onto said coin dispensing disc.

13. The coin dispenser according to claim 6, wherein said base member has a slot therein at a bottom of said bore, said slot defining an opening for receiving and passing foreign material received with said hopper.

* * * * *